US006289825B1

(12) United States Patent
Long

(10) Patent No.: US 6,289,825 B1
(45) Date of Patent: Sep. 18, 2001

(54) ADJUSTMENT MECHANISM FOR WORKSTATION

(76) Inventor: Dennis L. Long, 2161 Thornapple River Dr., Grand Rapids, MI (US) 49546

( * ) Notice: Subject to any disclaimer, the term of this patent is extended or adjusted under 35 U.S.C. 154(b) by 0 days.

(21) Appl. No.: 09/541,892

(22) Filed: Mar. 31, 2000

(51) Int. Cl.[7] ..... A47B 9/00
(52) U.S. Cl. ..... 108/147
(58) Field of Search ..... 108/147, 147.19, 108/144.11; 248/162.1, 404, 405, 406.2, 161, 157, 422, 188.3, 188.4

(56) References Cited

U.S. PATENT DOCUMENTS

| | | | | |
|---|---|---|---|---|
| 1,943,280 | | 1/1934 | Arnold . | |
| 3,856,252 | * | 12/1974 | Regis | 108/147 X |
| 4,493,469 | * | 1/1985 | Holobaugh | 108/147 X |
| 4,593,874 | * | 6/1986 | Dunagan | 108/147 X |
| 4,635,492 | | 1/1987 | Uebelhart . | |
| 4,747,353 | * | 5/1988 | Watt | 108/147 X |
| 5,022,327 | | 6/1991 | Solomon . | |
| 5,088,421 | | 2/1992 | Beckstead . | |
| 5,282,593 | | 2/1994 | Fast . | |
| 5,289,782 | * | 3/1994 | Rizzi et al. | 108/147 |
| 5,447,099 | | 9/1995 | Adams et al. . | |
| 5,601,037 | * | 2/1997 | Meyer et al. | 108/147 |
| 5,685,510 | | 11/1997 | Franklish . | |
| 5,706,739 | * | 1/1998 | Shaheen et al. | 108/147 |
| 5,845,590 | | 12/1998 | Seidl . | |
| 5,890,438 | | 4/1999 | Frankish . | |
| 5,941,182 | | 8/1999 | Greene . | |
| 6,026,755 | * | 2/2000 | Long | 108/147 |
| 6,131,870 | * | 10/2000 | Tseng | 108/147 X |
| 6,148,741 | * | 11/2000 | Motta | 108/147 X |

* cited by examiner

*Primary Examiner*—Jose V. Chen
(74) *Attorney, Agent, or Firm*—Mary M. Moyne; Ian C. McLeod

(57) ABSTRACT

The adjustment mechanism (10) includes a stationary first member (12) and a second member (20) telescopingly mounted in the first member. The first member is mounted with a second end (12B) adjacent the ground surface. The second member is mounted with the second end (20B) in the first end (12A) of the first member and the first end adjacent to and in contact with the underneath surface (102A) of the work surface (102). A threaded member (26) is rotatably connected at the first end (26A) to the upper end (20A) of the second member. The second end (26B) of the screw extends down through a top nut (38) fixably mounted on one end of a nut support (36). The other end of the nut support is mounted on the lower end of the first member. A spring (40) is mounted around the screw and the nut support extends between the lower end of the first member and the upper end of the second member. An operating mechanism is used to rotate the screw. The operating mechanism allows for fewer rotations of the handle (62) of the operating mechanism to move the work surface the desired amount.

53 Claims, 6 Drawing Sheets

ADJUSTMENT MECHANISM FOR WORKSTATION

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION (1) Field of the Invention

The present invention relates to an adjustment mechanism for adjusting the height of a work surface of a workstation. In particular, the present invention relates to an adjustment mechanism which uses rotation of a threaded member to adjust the height of the work surface. The threaded member is rotated by a handle through an operating mechanism having a series of sprockets and/or gears. The varying diameters of the gears allows the threaded member to rotate at a faster rate than the rate the handle is rotated. A spring is used to compensate for a load on the work surface and to allow the user to rotate the handle using less force.

(2) Description of the Related Art

The related art has shown various adjustable height workstations which use a rotating, threaded member and a stationary nut to adjust the height of the table or workstation. Illustrative are U.S. Pat. No. 1,943,280 to Arnold; U.S. Pat. No. 5,022,327 to Solomon; U.S. Pat. No. 5,447,099 to Adams et al; U.S. Pat. No. 5,685,510 to Francis; U.S. Pat. No. 5,845,590 to Seidel; U.S. Pat. No. 5,890,438 to Francis; and U.S. Pat. No. 5,941,182 to Greene.

Arnold describes a table having four adjustable legs. Each leg contains an adjustment mechanism which includes a screw and a stationary nut. A sprocket is mounted at the end of each screw. The sprockets of all four adjustment mechanisms are connected together by a chain. The chain passes about a drive sprocket which is mounted on a crank or handle. When the handle is rotated, the drive sprocket rotates which rotates the sprockets and screw of each adjustment mechanism.

Solomon describes an adjustable overbed table. A rotatable screw shaft is used to adjust the table. A crank handle is attached to bevel gears which rotate bevel gears on the end of the rotatable screw shaft.

Adams et al describes a height adjustment mechanism for tables. The drive means for the mechanism comprises a gear box, a jack screw and a jack nut with a crank for rotating the jack screw by means of a pair of bevel gears. One of the bevel gears is secured to the end of the jack screw.

Francis '510 and '586 describe a height adjustment system which includes a work-top member supported by a plurality of height adjustable legs. The legs have a stationary first leg part and a movable second leg part. A rotatable shaft extends vertically within the second leg part and has an upper portion and a lower portion. The lower portion is in the form of a screw. A pair of half nuts are positioned within the second leg part and act to position the screw within the second leg part. Vertical movement of the second leg part is also guided by at least one (1) linear bearing spaced between the first and second leg parts. The upper portion of the rotatable shaft is housed within a tubular member. A compression spring may be provided around the tubular member within the second leg part. The compression spring is retained between the lower part of the gear box housing and the base plate at the lower end of the first leg part. The compression spring is not rotatable and is fully supported within the second leg part to prevent buckling of the first leg part. The compression spring can compensate for external loads in the leg. The second leg part is secured at the upper end to the right angle gear box. The gear box includes a crown gear mounted on the upper end of the vertical shaft and a pinion gear engageable with the crown gear. The pinion gear is mounted on the end of a rotatable horizontal shaft which extends in a horizontal direction out of the gear box. The horizontal shaft is rotated by a drive mechanism comprising a winding mechanism including a rotatable drive shaft linked by universal joints and a first rotatable transmission member to a drive shaft. The drive shaft is connected to a rotatable drive transmission member which is connected to the horizontal shaft. A retractable handle is connected to the drive shaft for operating the winding mechanism. When the screw is rotated, the second leg part, gear box and work-top member move vertically relative to the first leg part.

Seidel describes an adjustable height table assembly. The base assembly includes a housing with a vertical leg extending upward and attached to the table top and movable within the housing. The housing also includes a pair of vertical guide members spaced from each other with a slide assembly slidably mounted to the guide members. The vertical leg is fixably mounted to the slide assembly. The vertical adjustment mechanism for the assembly includes a rotatable screw extending through a passage defined by the vertical leg. A tubular member is mounted within the housing between the vertical guide members, and receives the lower portion of the threaded member. A fixed nut is mounted toward the upper end of the tubular member and is threadably engaged with the threads of the screw. The table top support further includes an arm to which the table top is secured. The arm defines an axial passage, which is in communication with the passage formed in the vertical leg through which the screw extends. A driven sprocket is mounted to the screw toward its upper end, and a drive sprocket is rotatably mounted to the arm below the table top. A chain is engaged with the drive sprocket and with the driven sprocket, and a manually operable crank provides rotation of the drive sprocket, which is transferred through the chain and the driven sprocket to impart rotation to the screw and to thereby adjust the height of the table top.

Greene describes a vertically adjustable table which is adjustable using a crank handle. The leg assemblies include a stationary part and a movable part. The lifting mechanism comprises a ball screw and a ball nut. The ball nut is rigidly affixed to the stationary part of the leg assembly and the ball screw rotates in the ball nut. The table top is raised or lowered depending on the direction of rotation of the screw. The table uses a pulley and cable arrangement to ensure that the table raises and lowers in a level manner which obviating the need for a chain and sprocket. A miter gear set is used to convert horizontal torque applied by the user on the handle to the vertical torque needed to rotate the ball screw. The gear box mechanism is securely attached to a bracket which is secured to the movable portion of the leg assembly and to the underside of the table. The gear box mechanism is also securely attached to the ball screw.

Also of interest are U.S. Pat. No. 4,635,492 to Uebelhart; U.S. Pat. No. 5,088,421 to Beckstead and U.S. Pat. No.

5,282,593 to Fast which show the use of a motor to rotate the threaded member to adjust the height of a table or workstation.

There remains the need for an adjustment mechanism for use in adjusting the height of a work surface of a workstation which is manually operated by a handle which allows for fewer rotations of the handle by the user to obtain the required height adjustment and which uses a spring to compensate for a load on the work surface.

SUMMARY OF THE INVENTION

The present invention relates to an adjustment mechanism for vertically adjusting a work surface of a workstation, which comprises: a stationary first member defining a longitudinal axis of the mechanism; a movable second member connected to the work surface of the workstation and being movable relative to the stationary first member in a substantially vertical direction along the longitudinal axis of the mechanism; a support having a first end and a second end and fixably mounted at the second end to the stationary first member and having a threaded opening at the first end and a bore extending from the threaded opening toward the second end of the support substantially along the longitudinal axis of the mechanism; a threaded member rotatably connected to the movable second member and extending through the threaded opening of the support into the bore wherein threads of the threaded member engage threads of the threaded opening; a spring extending between the stationary first member and the movable second member substantially along the longitudinal axis of the mechanism and tending to bias the members apart; and an operating mechanism for rotating the threaded member in the threaded opening of the support wherein as the threaded member rotates, the second member moves relative to the first member and the spring compressed or extends based on a direction of rotation of the threaded member.

Further, the present invention relates to an adjustment mechanism for vertically adjusting a work surface of a workstation, which comprises: a first member having a first end and a second end with a bore extending therebetween; a second member telescopingly mounted in the bore of the first member and having a first end and a second end with a bore extending therebetween with the first end mounted adjacent the work surface of the workstation; a support having a first end and a second end with a bore extending therebetween having a threaded opening at the first end and mounted in the bore of the first member such that the second end of the support is adjacent the second end of the first member and the first end of the support is adjacent the first end of the first member; a threaded member rotatably mounted in the bore of the second member having a first end and a second end defining a longitudinal axis of the adjustment mechanism with the first end rotatably mounted adjacent the first end of the second member wherein the second end of the threaded member extends through the threaded opening in the first end of the support and into the bore of the support; a first gear mounted on the first end of the threaded member; a second gear in contact with the first gear having a diameter greater than a diameter of the first gear and mounted on a first shaft having a longitudinal axis parallel to the longitudinal axis of the adjustment mechanism; a first sprocket connected to the second gear; a second sprocket spaced apart from and connected to the first sprocket and mounted on a second shaft having a longitudinal axis parallel to the longitudinal axis of the adjustment mechanism; and a handle connected to the second shaft for rotating the second sprocket wherein rotating the handle rotates the second sprocket which rotates the first sprocket which rotates the second gear which rotates the first gear and the threaded member and wherein as the threaded member rotates in the threaded opening in the support, the second member is moved within the first member to vertically adjust the work surface of the workstation.

Still further, the present invention relates to an adjustment mechanism for vertically adjusting a work surface of a workstation, which comprises: a stationary first member defining a longitudinal axis of the mechanism; a movable second member connected to the work surface of the workstation and being movable relative to the stationary first member in a substantially vertical direction along the longitudinal axis of the mechanism; a support having a first end and a second end and fixably mounted at the second end to the stationary first member and having a threaded opening at the first end and a bore extending from the threaded opening toward the second end of the support substantially along the longitudinal axis of the mechanism; a threaded member rotatably connected to the movable second member and extending through the threaded opening of the support into the bore wherein threads of the threaded member engage threads of the threaded opening; a spring extending between the stationary first member and the movable second member substantially along the longitudinal axis of the mechanism; a first gear mounted on the threaded member spaced apart from the stationary first member; a second gear mounted on a first shaft and positioned to engage the first gear; a first sprocket connected to the second gear; a second sprocket mounted on a rotatable second shaft spaced apart from the first shaft wherein the second sprocket is connected by a connection means to the first sprocket and wherein a diameter of the second sprocket is greater than a diameter of the first sprocket; and rotation means for rotating the second rotatable shaft wherein when the second rotatable shaft is rotated, the second sprocket is rotated which rotates the first sprocket and the second gear which rotates the first gear and the threaded member and wherein as the threaded member rotates in the threaded opening of the support, the movable second member moves relative to the stationary first member to adjust the work surface of the workstation.

Further still, the present invention relates to an adjustment mechanism for vertically adjusting a work surface of a workstation, which comprises: a first member having a first end and a second end with a bore extending therebetween; a second member telescopingly mounted in the bore of the first member and having a first end and a second end with a bore extending therebetween with the first end mounted adjacent the work surface of the workstation; a support having a first end and a second end with a bore extending therebetween having a threaded opening at the first end and mounted in the bore of the first member such that the second end of the support is adjacent the second end of the first member and the first end of the support is adjacent the first end of the first member; a threaded member rotatably mounted in the bore of the second member having a first end and a second end defining a longitudinal axis of the adjustment mechanism with the first end rotatably mounted adjacent the first end of the second member wherein the second end of the threaded member extends through the threaded opening in the first end of the support and into the bore of the support; a spring mounted in the bore of the second member and around the threaded member having a first and a second end with the first end adjacent the first end of the second member and the second end adjacent the second end of the first member; a first gear mounted on the first end of the threaded member; a second gear in contact with the first gear and mounted on a first shaft having a longitudinal axis parallel to the longitudinal axis of the adjustment mechanism and having a diameter greater than a diameter of the first gear; a first sprocket connected to the second gear; a second sprocket spaced apart from and connected to the first sprocket and mounted on a second shaft having a longitudinal axis parallel to the longitudinal axis of the adjustment mechanism; and a handle connected to the second shaft for rotating the second sprocket wherein rotating the handle rotates the second sprocket which rotates the first sprocket which rotates the second gear which rotates the first gear and the threaded member and wherein as the threaded member rotates in the threaded opening in the support, the second member is moved within the first member to vertically adjust the work surface of the workstation.

Finally, the present invention relates to a method for adjusting a height of a work surface of a workstation which comprises the steps of: providing an adjustment mechanism for the work surface of the workstation, the adjustment mechanism including a stationary first member defining a longitudinal axis of the mechanism; a movable second member connected to the work surface of the workstation and being movable relative to the stationary first member in a substantially vertical direction along the longitudinal axis of the mechanism; a support having a first end and a second end and fixably mounted at the second end to the stationary first member and having a threaded opening at the first end and a bore extending from the threaded opening toward the second end of the support substantially along the longitudinal axis of the mechanism; a threaded member rotatably connected to the movable second member and extending through the threaded opening of the support into the bore wherein threads of the threaded member engage threads of the threaded opening; a spring extending between the stationary first member and the movable second member substantially along the longitudinal axis of the mechanism; a first gear mounted on the threaded member spaced apart from the stationary first member; a second gear rotatably mounted on a first shaft and positioned to engage the first gear wherein a diameter of the second gear is greater than a diameter of the first gear; a first sprocket rotatably mounted on the first shaft; a second sprocket mounted on a rotatable second shaft spaced apart from the first shaft wherein the second sprocket is connected by a connection means to the first sprocket; and rotation means for rotating the second rotatable shaft wherein when the second rotatable shaft is rotated, the second sprocket is rotated which rotates the second gear which rotates the first gear and the threaded member and wherein as the threaded member rotates in the threaded opening of the support, the movable second member moves relative to the stationary first member to adjust the work surface of the workstation; and activating the rotation means such that the second shaft and second sprocket rotate which rotates the first sprocket, first shaft and second gear which rotates the first gear and the threaded member which moves the second member relative to the first member which adjusts the height of the work surface The adjustment mechanism of the present invention allows for quick and relatively effortless adjustment of a work surface of a workstation. The adjustment mechanism includes a stationary outer member and a movable inner member telescopingly mounted in the first member. The first member is mounted with a lower end adjacent the ground surface. The inner member is mounted with the lower end in the upper end of the outer member and the upper end adjacent to and in contact with the underneath surface of the work surface. A screw is rotatably connected at the first end to the upper end of the inner member. The second end of the screw extends down through a nut cap fixably mounted on one end of a nut support. The other end of the nut support is mounted on the lower end of the outer member. A spring is mounted around the screw and the nut support and extends between the lower end of the outer member and the upper end of the inner member.

Preferably, a first gear is fixably mounted on the first end of the screw. A second gear is mounted on a first shaft adjacent the first gear and engages the first gear. The second gear preferably has a greater diameter than the first gear. A first sprocket is also mounted on the first shaft. The first sprocket is connected by a chain to a second sprocket mounted on a second shaft. The diameter of the second sprocket is preferably greater than the diameter of the first sprocket. The handle for operating the adjustment mechanism is connected to the second shaft. As the handle is rotated, the first and second sprockets and the first and second gears rotate which rotates the screw. Due to the larger diameter of the second gear and the second sprocket, the first gear and the screw rotate at a faster rate than the rotation of the handle. The spring compensates for the load on the work surface and allows for the use of reasonable force by the user to rotate the handle even with a load on the work surface and the ratio of the gears and sprockets. As the screw rotates, it moves up and down in the top nut causing the inner member to move up and down in the outer member, thus raising or lowering the work surface.

An alignment sprocket is preferably fixably mounted on the upper end of the screw. The alignment sprocket is connected by a chain to the alignment sprockets of the adjustment mechanism for the workstation. The alignment sprockets ensure that all the adjustment mechanisms adjust the work surface at the same rate. The alignment sprocket also allows the use of a single operating mechanism for multiple adjustment mechanisms of a single workstation. All of the alignment mechanisms of a workstation are preferably operated by a single operating mechanism.

The adjustment mechanism of the present invention allows for adjusting a work surface of a workstation a greater distance in fewer rotations of the handle. The adjustment mechanism also allows for the use of a substantially constant force to rotate the handle regardless of the position of the work surface. The adjustment mechanism also provides for applying a manageable force on the handle to adjust the work surface even when a load is applied to the work surface.

The substance and advantages of the present invention will become increasingly apparent by reference to the following drawings and the description.

BRIEF DESCRIPTION OF THE DRAWING(S)

Figure 3A:
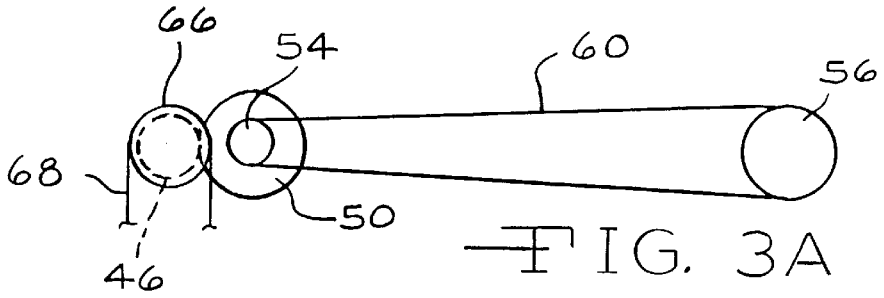
FIG. 3 is a side cross-sectional view of the workstation 100 in the lowered position with a portion of the adjustment mechanism 10 in cross-section.

FIG. 3A is a plan view of gears 46 and 50 and sprockets 54, 56 and 66.

Figure 2:
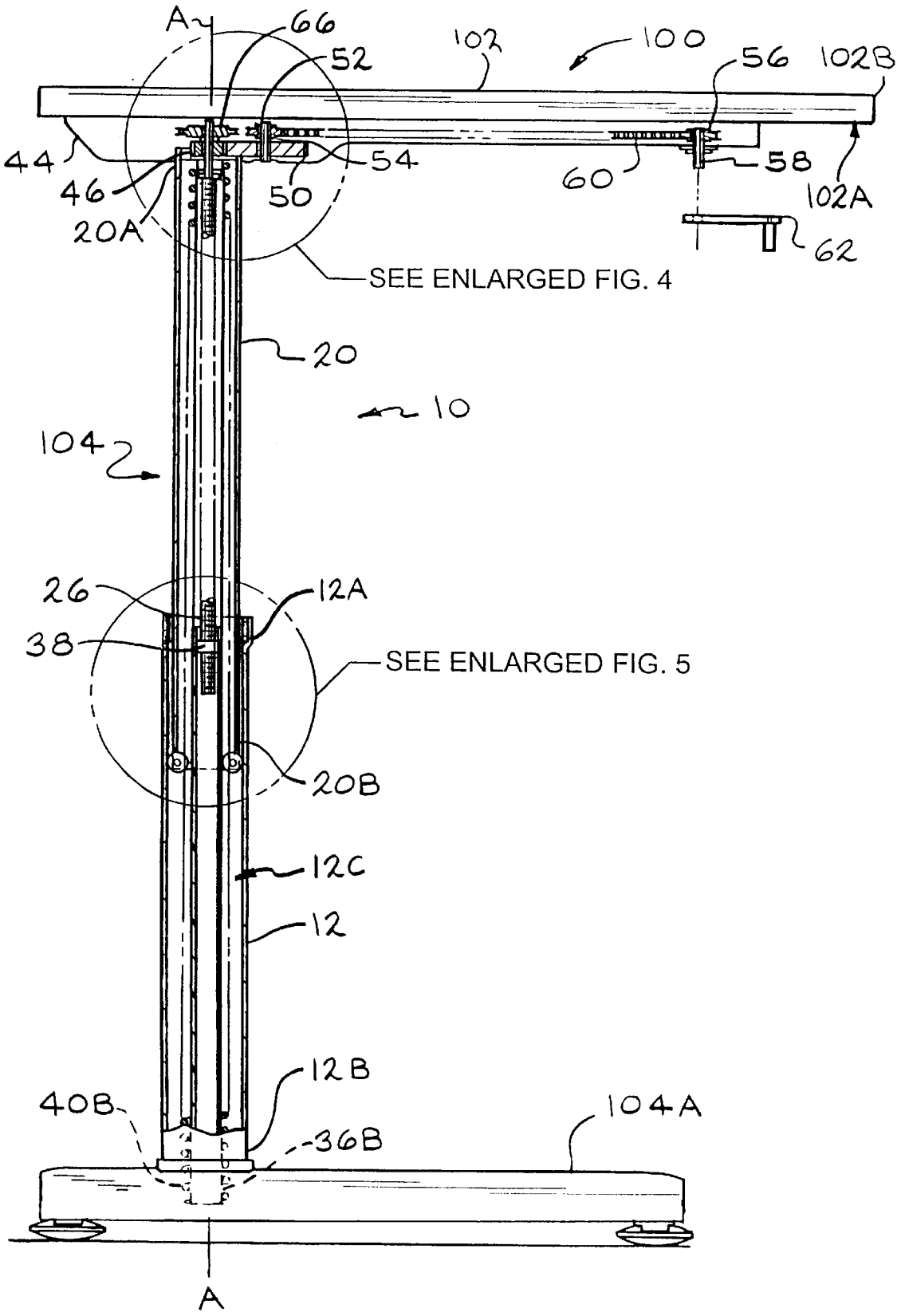
FIG. 2 is a side cross-sectional view of the workstation 100 in the raised position with a portion of the adjustment mechanism 10 in cross-section.
Figure 4:
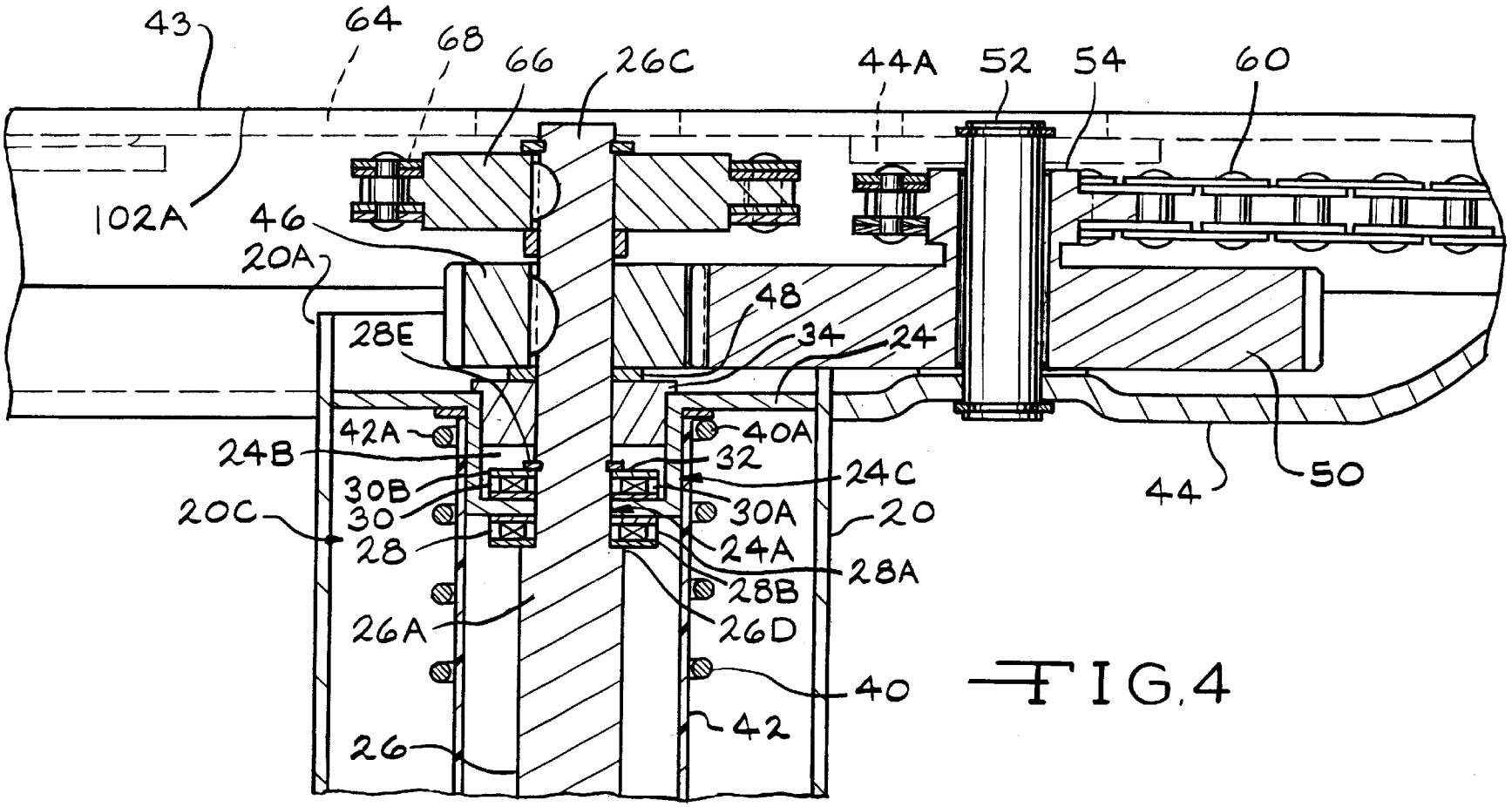

FIG. 4 is an enlarged cross-sectional view of a portion of FIG. 2 showing the first gear 46 and the alignment sprocket 66 mounted on the screw 26 and showing the second gear 50 and the first sprocket 54 mounted on the bearing first shaft 52.

Figure 5:
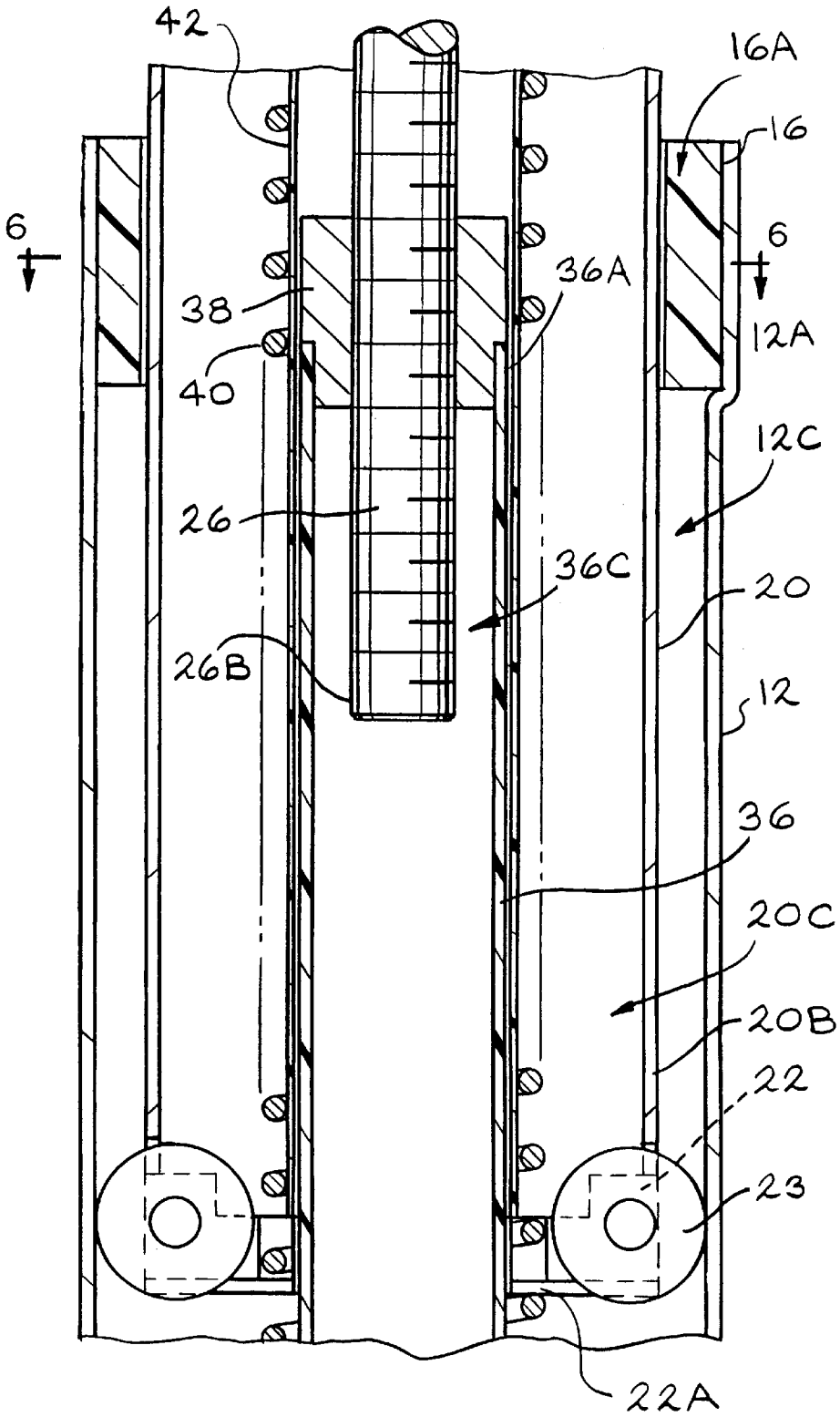

FIG. 5 is an enlarged cross-sectional view of a portion of FIG. 2 showing the roller assembly 22, the screw 26 and the support 36.

Figure 6:
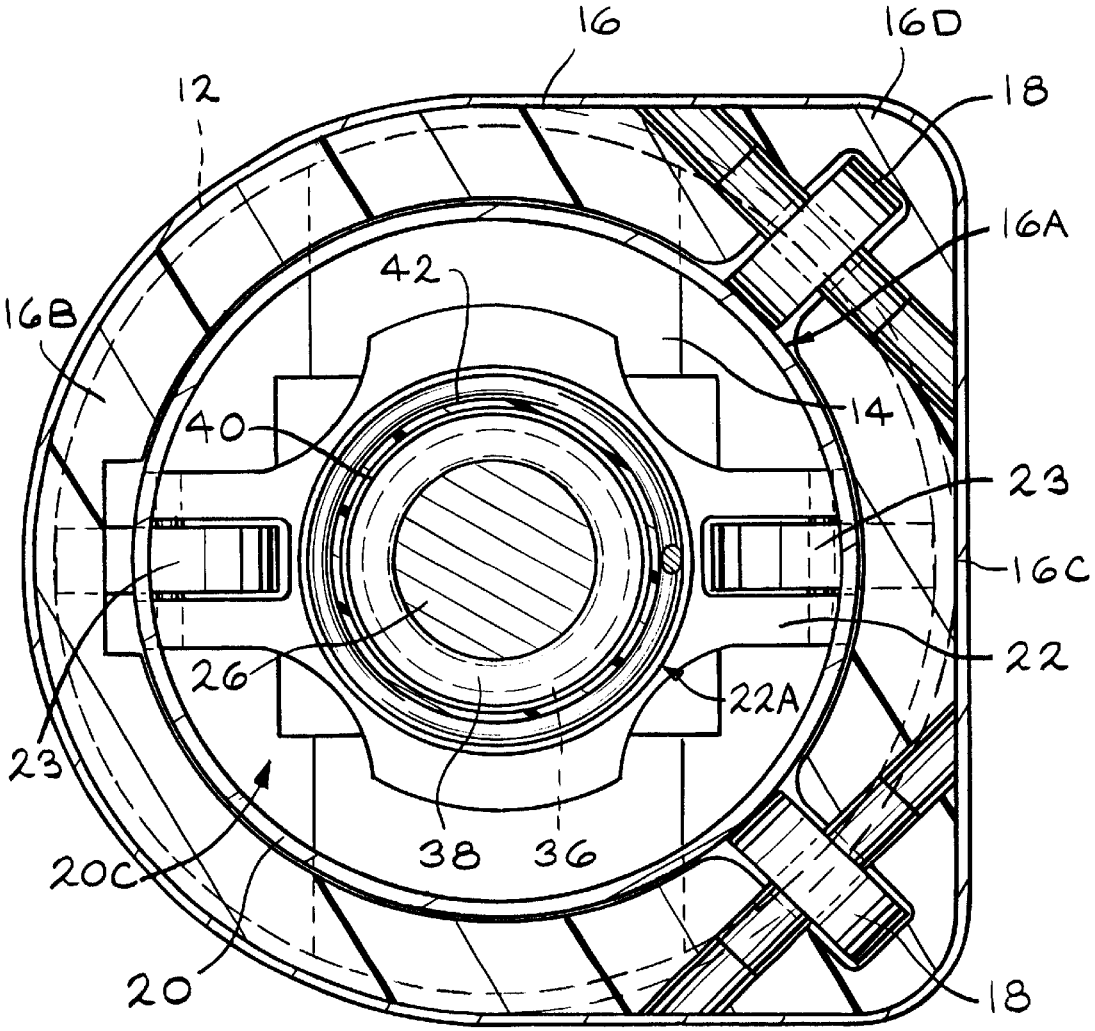

FIG. 6 is a cross-sectional view along the line 6—6 of FIG. 5 showing the first cantilever bracket 16 and first cantilever rollers 18 and the second cantilever bracket 22.

DETAILED DESCRIPTION OF THE PREFERRED EMBODIMENTS

Figure 1:
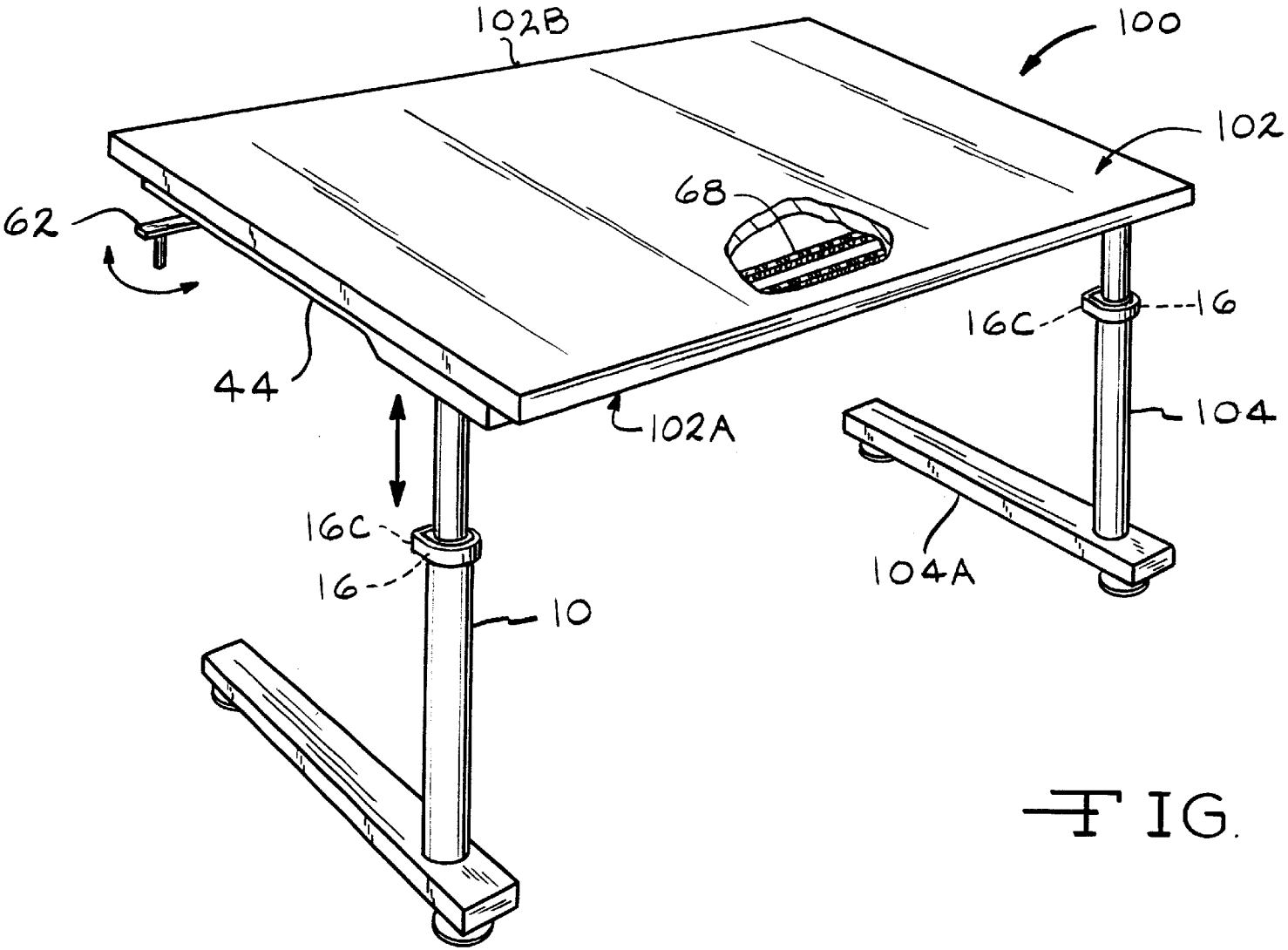
FIG. 1 is a perspective view of the workstation 100 having the adjustment mechanism 10.

FIG. 1 shows the workstation 100 having the adjustment mechanism 10 of the present invention. An adjustment mechanism 10 provides a portion of each of the legs 104 for the workstation 100. A single operating mechanism is used for both adjustment mechanisms 10. The adjustment mechanism 10 extends between the foot 104A of the leg 104 and the work surface 102. In the embodiment shown, the workstation 100 has a rectangular work surface 102 with a pair of legs 104 spaced apart beneath the work surface 102. Each of the legs 104 is provided with an adjustment mechanism 10. However, it is understood that the work surface 102 could be of any size or shape. In addition, the number of adjustment mechanisms 10 would depend on the size of the work surface 102 and the load on the work surface 102. In the current embodiment, the adjustment mechanism 10 is not enclosed within a housing. However, it is understood that the adjustment mechanism 10 can be enclosed in a housing or outer fascia having any shape.

The adjustment mechanism 10 of the present invention includes a stationary first or outer member 12 and a movable second or inner member 20 (FIGS. 1 and 2). The members 12 and 20 are telescopingly mounted together such that the second member 20 is able to move relative to the first member 12 essentially along the longitudinal axis A—A of the adjustment mechanism 10. In the preferred embodiment, the members 12 and 20 are preferably tubes having a cylindrical shape with a circular cross-section. The members 12 and 20 could have any cross-sectional shape. In the preferred embodiment, the members 12 and 20 both have the same cross-sectional shape. However, the members 12 and 20 could have different cross-sectional shapes provided the members are able to be telescopingly mounted together. The outer and inner members 12 and 20 are preferably constructed of metal; however, the members can be constructed of any durable, strong material.

The first or outer member 12 has a first or upper end 12A and a second or lower end 12B with a center bore 12C extending therebetween. The upper end 12A of the outer member 12 is open to allow for insertion of the second or inner member 20. The lower end 12B of the outer member 12 can be closed or open. In the preferred embodiment, the outer member 12 is fixably mounted at the lower end 12B to the foot 104A of the leg 104 of the workstation 100. The lower end 12B of the outer member 12 can also extend through the foot 104A and be mounted in the foot 104A. A bracket 14 (FIG. 6) is preferably located on the lower end 12B of the first member 12. The bracket 14 extends across the open lower end 12B of the outer member 12 and allows for mounting of the nut support 36. The bracket 14 also provides a surface to which the bottom 40B of the spring 40 rests and pushes against. In an alternative embodiment (not shown), the bracket at the lower end of the first member is a plate which extends completely across and completely covers and closes the lower end of the first member. In the preferred embodiment, a first cantilever bracket 16 is mounted in the upper end 12A of the first member 12 (FIG. 6). The first cantilever bracket 16 has a center opening 16A having a circular shape and an outer perimeter having a D-shape with a curved portion 16B and a straight portion 16C. In the preferred embodiment, the upper end 12A of the outer member 12 is stretched or deformed such that the D-shaped first cantilever bracket 16 can be mounted in the center bore 16C of the outer member 12 adjacent the upper end 12A. The intersections of the curved portion 16B with the straight portion 16C of the outer perimeter form corner areas 16D of the first cantilever bracket 16. The curved portion 16B of the perimeter of the first cantilever bracket 16 follows the curved perimeter of the outer member 12. The straight portion 16C and the corner areas 16D extend outward beyond the standard perimeter of the outer member 12 below the upper end 12A. First cantilever rollers 18 are mounted in each of the corner areas 16D. The axises of rotation of the first cantilever rollers 18 are perpendicular to the longitudinal axis of the adjustment mechanism 10. The first cantilever rollers 18 are mounted in the corner areas 16D such that a portion of the first cantilever rollers 18 extend into the center opening 16A of the first cantilever bracket 16. Each of the first cantilever rollers 18 extends into the center opening 16A the same distance. The first cantilever rollers 18 extend into the center opening 16A such as to contact the inner member 20 as it moves within the center bore 12C of the outer member 12. The first cantilever bracket 16 is mounted in the upper end 12A of the outer member 12 such that the straight portion 16C of the bracket 16 is facing and substantially parallel to a front edge 102B of the work surface 12 (FIG. 1). The first cantilever rollers 18 are preferably spaced apart approximately 45° around the center opening 16A. The first cantilever rollers 18 can be of any well known type and can be constructed of any well known material. The first cantilever bracket 16 is preferably constructed of plastic; however, it can be constructed of any durable material.

The second or inner member 20 has a first or upper end 20A and a second or lower end 20B with a center bore 20C extending therebetween. The lower end 20B of the inner member 20 is telescopingly received in the open upper end 12A of the outer member (FIG. 5). The outer diameter of the inner member 20 is of a size such that the inner member 20 easily slides within the center bore 12C of the outer member 12. A second cantilever bracket 22 is mounted on the lower end 20B of the inner member 20 within the center bore 12C of the outer member 12 (FIGS. 5 and 6). The second cantilever bracket 22 includes a pair of rollers 23 which compensate for the cantilever of the table as shown in FIG. 1. The second cantilever bracket 22 has a center opening 22A which allows the spring 40, screw 26 and nut support 36 to extend between the outer and inner members 12 and 20. The size of the center opening 22A is such that the spring 40 does not contact the bracket 14 and can move easily within the center opening 16A of the bracket 14. The axises for rotation of the rollers 23 are perpendicular to the longitudinal axis A—A of the adjustment mechanism 10. The rollers 23 are mounted on the bracket 22 such that the rollers 23 extend beyond the outer surface of the inner member 20. The inner member 20 is provided with slots such that the rollers 23 extend through the inner member 20. In the preferred embodiment, the rollers 23 are spaced a minimal distance from the inner surface of the outer member 12 when the second member 20 is sliding within the center bore 12C of the outer member 12 during normal conditions such that if the inner member 20 is cantilevered or tilted, the second cantilever rollers 23 contact the outer member 12. The rollers 23 can be of any type and can be constructed of any well known, durable, low friction material. The bracket 14 can be constructed of any material and can be mounted on the end of the inner member 20 by any well known means.

Figure 3:
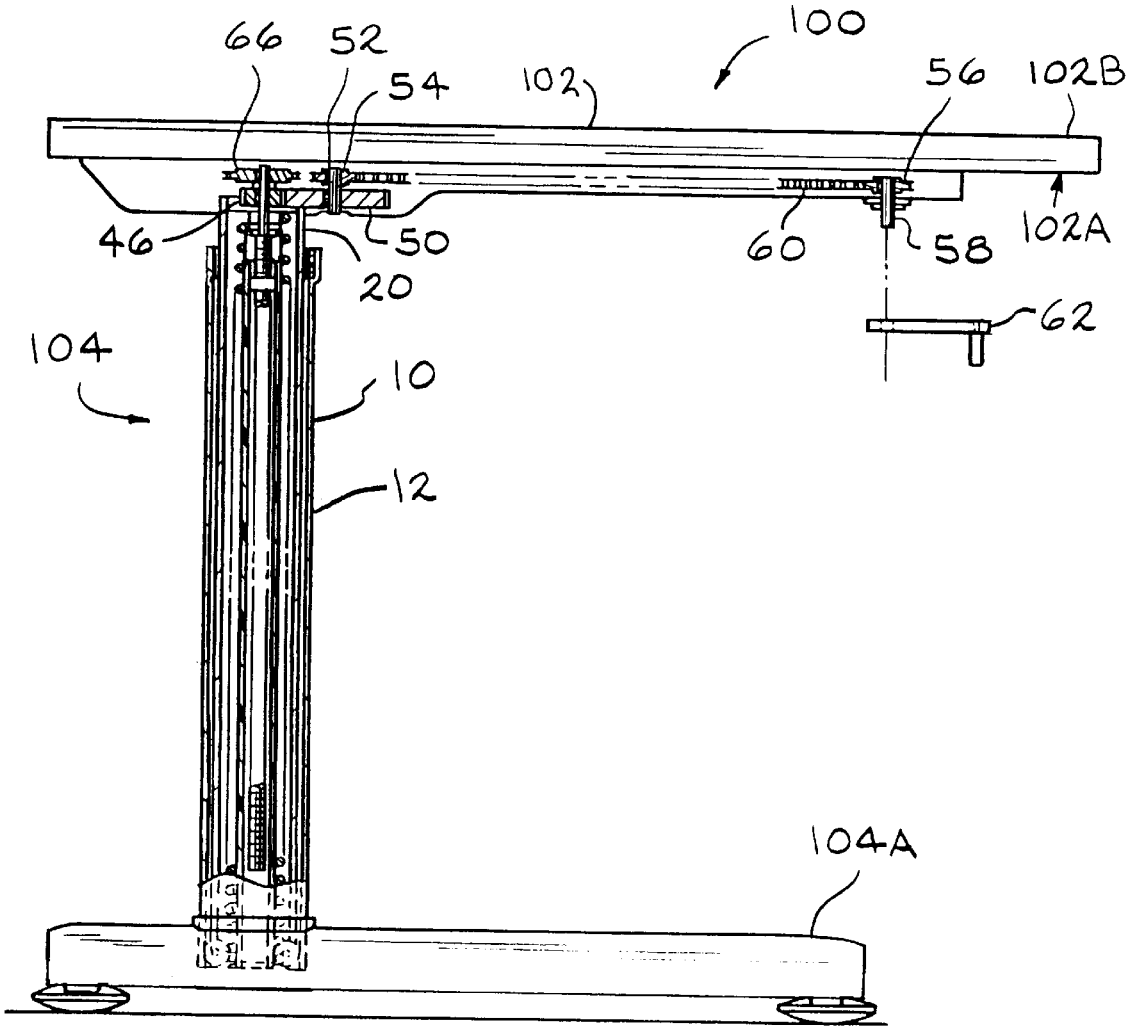

The upper end 20A of the inner member 20 is preferably fixably mounted to the cover 44 for the operating mechanism adjacent the underneath surface 102A of the work surface 102 (FIG. 4). The upper end 20A of the inner member 20 is preferably provided with a cutout portion to allow for the second gear 50 (FIGS. 3 and 4) to extend into the center bore 20C of the inner member 20 and engage the first gear 46 (to be described in detail hereinafter). In an alternative embodiment (not shown), the upper end of the inner member is secured directly to the underneath surface of the work surface. In this alternate embodiment, the inner member has a cutout for the second gear and a cutout or notch for the connecting chain of the alignment sprocket. An inner plate 24 is provided in the center bore 20C of the inner member 20 spaced down from but adjacent to the upper end 20A of the inner member 20 (FIG. 4). The inner plate 24 closes the center bore 20C of the inner member 20 at the upper end 20A except for a center opening 24A through the inner plate 24. The center opening 24A is positioned in an indention 24B in the center of the inner plate 24. The center opening 24A and the indention 24B preferably both have a circular shape.

A threaded member or screw 26 is rotatably mounted in the center bore 20C of the inner member 20. The screw 26 has a first end 26A and a second end 26B. The outer surface of the screw 26 is provided with threads except for a top portion 26C of the screw 26 adjacent the upper end 20A of the inner member 20 (FIG. 4). The top portion 26C of the screw 26 preferably has a smaller diameter than the remainder of the screw 26. A shoulder 26D is formed at the point where the reduced diameter top portion 26C of the screw 26 begins. The first end 26A of the screw 26 preferably extends through the center opening 24A of the inner plate 24 and beyond the upper end 20A of the inner member 20. In the preferred embodiment, the first end 26A of the screw 26 is spaced slightly down from the underneath surface 102A of the work surface 102 (FIG. 4). A thrust assembly 28 and 30 is preferably positioned on either side of the inner plate 24 around the screw 26. The thrust assemblies 28 and 30 include a thrust bearing 28A or 30A spaced between a pair of thrust washers 28B or 30B. The first thrust assembly 28 is spaced between the inner plate 24 and the shoulder 26D formed by the top portion 26C of the screw 26. The second thrust assembly 30 is spaced around the top portion 26C of the screw 26 adjacent a floor of the indention 24B of the inner plate 24. A lock clip 32 is mounted in a groove 28E in the top portion 26C of the screw 26 adjacent the second thrust assembly 30 and holds the second thrust assembly 30 in place adjacent the floor of the indention 24B of the inner plate 24. A flange bearing 34 is preferably mounted in the indention 24B of the plate 24 adjacent the top of the indention 24B. The flange bearing 34 has a center opening through which the top portion 26C of the screw 26 rotatably extends. The flange bearing 34 acts to align the screw 26 such that the screw 26 is co-axial with the inner and outer members 12 and 20. The screw 26 extends downward from the first end 26A toward the lower end 20B of the inner member 20. The second end 26B of the screw 26 extends into a first end 36A of a nut support 36.

As shown in FIG. 5, the nut support 36 has a first end 36A and a second end 36B with a center bore 36C extending therebetween. In the preferred embodiment, the center bore 36C extends completely through the nut support 36. However, the second end 36B of the nut support 36 may be closed and the center bore 36B may not extend the complete length of the support 36. The length of the center bore 36B of the nut support 36 depends on the length of the screw 26. The diameter of the center bore 36C of the nut support 36 is greater than the diameter of the screw 26 such that the screw 26 easily extends into the center bore 36C of the nut support 36. A top nut 38 is threadably mounted in the first end 36A of the nut support 36. The nut support 36 acts to support the top nut 38 in a fixed position spaced a distance from the lower end 12B of the outer member 12. The nut support 36 is of such a length that the top nut 38 is positioned in the center opening 16A of the first cantilever bracket 16. The top nut 38 has a threaded center opening which leads to the center bore 36C of the nut support 36. The diameter and threads of the threaded opening are such as to engage the threads of the screw 26 as the screw 26 extends through the threaded opening of the top nut 38 and into the center bore 36C of the nut support 36. The second end 36B of the nut support 36 is fixably mounted on the bracket 14 at the second end 12B of the outer member 12. The length of the nut support 36 is preferably less than the length of the outer member 12 such that the top nut 38 of the nut support 36 is spaced below the upper end 12A of the outer member 12. The nut support 36 is preferably constructed of metal; however, any well known, durable material can be used.

A spring 40 preferably extends between the bracket 14 at the lower end 12B of the outer member 12 and the inner plate 24 at the upper end 20A of the inner member 20. The spring 40 is preferably mounted around the screw 26 and the nut support 36 and has an outer diameter such as to be spaced apart from the inner surface of the inner member 20. The bottom end 40B of the spring 40 preferably rests on the bracket 14 at the lower end 12B of the outer member 12. The force on the spring 40 due to its compressed condition tends to keep the spring 40 in position on the bracket 14. The top end 40A of the spring 40 is adjacent the inner plate 24 of the inner member 20. The spring 40 preferably has a compressed length of 37.69 inches (95.73 cm) when the adjustment mechanism 10 is in the fully extended or raised position and a compressed length of 21.69 inches (55.09 cm) when the adjustment mechanism 10 is in the fully compressed or lowered position. The spring 40 preferably counteracts the downward force of the work surface 102, operating mechanism, the inner member 20 and any load on the work surface 102. The characteristics of the spring 40 are preferably chosen based on the anticipated load to be provided on the work surface 102. In the preferred embodiment, a spring support or liner 42 extends between the inner plate 24 of the inner member 20 and the second end 20B of the second member 20. The spring liner 42 preferably does not extend into the center opening 22A of the second cantilever bracket 22. The outer diameter of the spring liner 42 is preferably only slightly less than the inner diameter of the spring 40 such that the spring 40 fits snugly on the spring liner 42. In the preferred embodiment, the indention 24B of the inner plate 24 has a cylindrical shape and forms a downward extension having a diameter less than the inner diameter of the spring liner 42 such that the top end 42A of the spring liner 42 is friction fit over the extension as it extends downward from the inner plate 24. The spring liner 42 is spaced between the protrusion and the spring 40. In the preferred embodiment, the top end 40A of the spring 40 is held between the top end 42A of the spring liner 42 and the inner plate 24 which holds the top end 40A of the spring 40 in position. The spring liner 42 is preferably constructed of plastic; however, any well known durable material can be used.

As seen in FIGS. 2 and 4, the operating mechanism used to rotate the screw 26 of the adjustment mechanism 10 and adjust the work surface 102 includes gears 46 and 50, sprockets 54 and 56, a chain 60 and a handle 62. The operating mechanism is preferably positioned adjacent the underneath surface 102A of the work surface 102. The gears 46 and 50, sprockets 54 and 56 and shafts 52 and 58, of the operating mechanism are preferably mounted in a mounting cover 44. The mounting cover 44 has a floor and an open top. Braces 44A extend across the open top and allow for mounting the top ends of the first and second shafts 52 and 58 to the mounting cover 44. A top mounting bracket 43 is mounted over and secured to the open top of the mounting cover 44. The top mounting bracket 43 is secured to the underneath surface 102A of the work surface 102 and allows for securing the operating mechanism in the mounting cover 44 to the underneath surface 102A of the work surface 102. A first gear 46 for the operating mechanism is preferably fixably mounted on the top portion 26C of the screw 26. The first gear 46 is preferably fixably mounted on the screw by a key and slot arrangement or a woodruff key. The first gear 46 is preferably mounted above the inner plate 24. In the preferred embodiment, the first gear 46 is partially within the center bore 20C of the second member 20. The first gear 46 is spaced from the flange bearing 34 in the indention 24B of the inner plate 24 by a spacer 48. The second gear 50 of the operating mechanism is mounted on a first shaft 52 adjacent to and in the same horizontal plane as the first gear 46. The first shaft 52 is spaced apart from the screw 26 such that the teeth of the second gear 50 engage the teeth of the first gear 46. The second gear 50 preferably has a pitch diameter greater than the first gear 46. In the preferred embodiment, the first gear 46 has a pitch diameter of 1.167 inches (2.96 cm) and the second gear 50 has a pitch diameter of 3.000 inches (7.62 cm). The second gear 50 is preferably approximately 2.57 times larger than the first gear 46. The longitudinal axis of the first shaft 52 is preferably parallel to the longitudinal axis of the adjustment mechanism 10. The first shaft 52 is preferably fixably mounted at one (1) end to the brace 44A extending across the open top of the mounting cover 44. The other end of the first shaft 52 is preferably fixably mounted to the floor of the mounting cover 44 for the operating mechanism. A first sprocket 54 is also mounted on the first shaft 52. In the preferred embodiment, the first sprocket 54 is located above the second gear 50 adjacent the brace 44A and the underneath surface 102A of the work surface 102. However, the first sprocket 54 can be positioned anywhere on the first shaft 52. In the preferred embodiment, the second gear 50 and the first sprocket 54 are connected together and can be constructed as a single piece and are rotatably mounted on the first shaft 52.

A second sprocket 56 is fixably mounted on a second shaft 58 spaced apart from the first sprocket 54. One end of the second shaft 58 is rotatably mounted in the brace 44A extending across the open top of the mounting cover 44. The other end of the second shaft 58 extends downward through an opening in the mounting cover 44. The second sprocket 56 is preferably in the same plane as the first sprocket 54 and the longitudinal axis of the second shaft 58 is preferably parallel to the longitudinal axises of the first shaft 52 and the adjustment mechanism 10. The second sprocket 56 preferably has a pitch diameter greater than the pitch diameter of the first sprocket 54. In the preferred embodiment, the first sprocket 54 has a pitch diameter of 0.966 inches (2.45 cm) and the second sprocket 56 has a pitch diameter of 1.995 inches (5.067 cm). Thus, the second sprocket 56 is approximately 2.07 times greater in diameter than the first sprocket 54. The first and second sprockets 54 and 56 are connected together by a chain 60. However, it is understood that the first and second sprockets 54 and 56 can be connected by any other means which allows for simultaneous rotation of the first and second sprockets 54 and 56. A handle 62 is connected to the second shaft 58 and allows for rotation of the second shaft 58. The handle 62 can be of any type and can be connected to the second shaft 58 in any way such as to rotate the second shaft 58. The second shaft 58 preferably has a length such as to extend downward beyond and through an opening in the mounting cover 44 such that the handle 62 is located outside of the cover 44. In an alternative embodiment (not shown), the second shaft 58 extends upward through the work surface 102 and the handle 62 is located above the work surface 102. The second sprocket 56 is preferably spaced apart from the first sprocket 54 toward the front or side of the workstation 100 such that the handle 62 is easily accessible to the user. The gears 46 and 50 and sprockets 54 and 56 are preferably constructed of metal. However, any durable material can be used.

In embodiments having more than one (1) adjustment mechanism 10, an alignment sprocket 66 is preferably fixably mounted on the screw 26. In the preferred embodiment, the alignment sprocket 66 is mounted on the top portion 26C of the screw 26 adjacent the underneath surface 102A of the work surface 102 such that the first gear 46 is spaced below the alignment sprocket 66. The alignment sprockets 66 of each of the adjustment mechanisms 10 are preferably connected together by an alignment chain 68. However, any connection means can be used provided that when the screw 26 of one of the adjustment mechanisms 10 is rotated, the screws 26 of the other adjustment mechanisms 10 are also rotated at the same rate.

In an alternative embodiment (not shown), the operating mechanism used to rotate the screw does not contain a first gear on the screw. In the alternative embodiment, gears and sprockets for the operating mechanism are positioned along the length of the alignment chain between the various adjustment mechanisms of the workstation. The system and sizes of the gears and sprockets used for the preferred embodiment can be used for this alternate embodiment with the addition of a drive sprocket. The ability to place the operating mechanism anywhere along the length of the alignment chain allows for varying the position of the handle such that the handle can be located at any position which is easily accessed by the user.

To adjust the height of the work surface 102, the user rotates the handle 62 of the operating mechanism. When the user rotates the handle 62, the handle 62 directly rotates the second shaft 58 having the second sprocket 56. As the second sprocket 56 rotates, the chain 60 connecting the first and second sprockets 54 and 56 together causes the first sprocket 54 and second gear 58 to rotate on the first shaft 52. As the second gear 50 rotates its engagement with the first gear 46 rotates the first gear 46 and the screw 26. The gears 46 and 50 and sprockets 54 and 56 of the operating mechanism provide a reduction ratio which allows for greater movement of the work surface 102 with fewer rotations of the handle 62. In the preferred embodiment, due to the difference in diameters of the first and second sprockets 54 and 56, when the handle 62 is rotated one (1) complete rotation, the second gear 50 rotates 2.07 rotations. Due to the larger diameter of the second gear 50 with respect to the first gear 46, when the second gear 50 rotates one (1) full rotation, the first gear 46 and screw 26 complete approximately 2.57 rotations. In the preferred embodiment, there is approximately a 5:1 reduction ratio from the handle 62 to the screw 26 through the gears 46 and 50 and sprockets 54 and 56. Therefore, when the handle 62 is rotated one (1) full rotation, the screw 26 rotates approximately five (5) times. In the preferred embodiment, the screw 26 has five (5) threads per inch such that when the screw 26 rotates approximately five (5) full rotations, the screw 26 and consequently the work surface 102A moves up or down one (1) inch. Thus, for every full rotation of the handle 62, the work surface 102 is adjusted up or down approximately one (1) inch (2.54 cm). The gears 46 and 50 and sprockets 54 and 56 of the operating mechanism can be chosen to provide any reduction ratio from the handle 62 to the screw 26.

Whether the user wants to adjust the work surface 102 up or down determines the direction the handle 62 is turned. The screw 62 preferably rotates in a direction opposite the direction of rotation of the second shaft 58. As the screw 26 rotates, the screw 26 moves up and down through the top nut 38, depending on the direction of rotation. The movement of the screw 26 up or down in the stationary top nut 38 causes the inner member 20 which is fixed to the screw 26 to also move up and down within the outer member 12 which is fixed to the nut support 36 and top nut 38. As the inner member 20 moves up and down relative to the outer member 12, the first cantilever rollers 18 of the first cantilever bracket 16 contact the outer surface of the inner member 20 and act to align the inner member 20 in the center bore 12C of the outer member 12 such that the outer and inner members 12 and 20 are co-axial. The first cantilever rollers 18 carry the cantilever load on the second member 20 as it enters the first member 12 caused by a load on a front edge 102B of the work surface 102 in front of the legs 104 of the workstation 100. In the preferred embodiment, under normal conditions, the load on the work surface 102 is spaced between the front edge 102B of the work surface 102 and the legs 104 or adjustment mechanism 10 of the workstation 100. The first cantilever rollers 18 preferably also prevent chattering of the adjustment mechanism 10 as the inner member 20 moves relative to the outer member 12. In the preferred embodiment, as the inner member 20 moves up and down in the outer member 12, the rollers 23 on the second cantilever bracket 22 at the lower end 20B of the inner member 20 do not contact the inner surface of the outer member 12. Having the rollers 23 spaced apart from the inner surface of the outer member 12 eliminates unnecessary friction during movement of the inner member 20 under normal conditions. Preferably, the rollers 23 only contact the inner surface of the outer member 12 when the inner member 20 is tilted or cantilevered in the outer member 12. Tilting of the inner member 20 may be caused when a load is placed on the front edge 102B or back edge of the work surface 102 such as to unbalance the work surface 102. The load causes the work surface 102 to tilt or pivot toward the load. Since the work surface 102 is connected to the inner member 20, tilting of the work surface 102 causes the inner member 20 to tilt in the outer member 12 and causes the lower end 20B of the inner member 20 to move off center toward the inner surface of the outer member 12. The rollers 23 of the second cantilever bracket 22 tend to prevent excess movement of the lower end 20B of the inner member 20 in the outer member 12. The second cantilever rollers 23 also allow the inner member 20 to continue to move within the outer member 12 even when the work surface 102 is tilted.

The spring 40 of the adjustment mechanism 10 compensates for the weight of the work surface 102, the inner member 20, the operating mechanism including the mounting cover 44 and top mounting bracket 43 and any load on the work surface 102 and for the 5:1 ratio of the gears 46 and 50 and sprockets 54 and 56. Due to the use of the 5:1 ratio of the gears 46 and 50 and sprockets 54 and 56, without the use of the spring 40 to assist in compensating for the weight of the work surface 102, operating mechanism and load, the amount of force required to rotate the handle 62 would be outside the normal range of force able to be applied by an average user. In the preferred embodiment, there are two (2) adjustment mechanisms 10 used to adjust the work surface 102. However, only one (1) operating mechanism is used for both alignment mechanisms 10. In the preferred embodiment, the spring 40 is chosen to compensate for the work surface weighing approximately 45 lbs. and the operating mechanism weighing approximately 35 lbs. The load on the work surface 102 is chosen to be 100 lbs. Thus, the total force being applied to the two (2) adjustment mechanisms 10 is 180 lbs or 90 lbs for each adjustment mechanism 10. In the preferred embodiment, the work surface 102 is able to be adjusted a total distance of 16 inches (38.4 cm). The adjustment mechanism 10 is designed such that at one (1) point of travel of the inner member 20, the spring 40 is in the neutral position and the effort at the handle 62 to move the work surface 102 with a load is zero (0). This point is variable and is preferably preset by the manufacturer. In the neutral position, the spring 40 provides a preset upward force. In the preferred embodiment, the preset upward force is 90 lbs for each adjustment mechanism 10. In the preferred embodiment, when the work surface 102 is spaced approximately 29 inches (69.6 cm) from the ground surface, the force or weight of the work surface 102, the operating mechanism and a 100 lb load pushing down on the two (2) adjustment mechanisms 10 is equal to the amount of upward force exerted by the spring 40 on the work surface 102. At this neutral position, each adjustment mechanism 10 preferably exerts an upward force of 90 lbs. Theoretically, at the neutral position, the only force needed to rotate the handle 62 to adjust the work surface 102 is the force to overcome friction of the adjustment mechanism 10. In the preferred embodiment, the spring 40 is linear and is chosen such that the force required to rotate the handle 62 having a length of 4.0 inches (10.2 cm) to adjust the work surface 102 at any height does not exceed 12 lbs when the load on the table is between the range of 0 and 150 lbs. The force required to rotate the handle 62 increases to the maximum as the work surface 102 is moved toward the fully lowered position and there is no load on the work surface 102. The force required to rotate the handle 62 increases to the maximum as the work surface 102 is moved to the fully raised position and there is a maximum load of 150 lbs on the work surface 102. In the preferred embodiment, the force required to rotate the handle 62 increases or decreases at a rate of 2 lbs/inch. Below the neutral position, it is more difficult to lower the work surface 102 due to the force of the spring 40 pushing upward. As the spring 40 is compressed or extended, the upward force of the spring 40 applied to the work surface 102 varies linearly. The application of the upward force by the spring 40 makes it easier for the adjustment mechanism 10 to raise the work surface 102, particularly when the work surface 102 has an additional weight or load. Thus, it is easier for the user to rotate the handle 62 to raise or lower the work surface 102. Optionally, the spring 40 is chosen such that the variation in the amount of force along a length of the spring 40 is minimal. The spring 40 regulates how much inch/pounds of torque will be needed to turn the handle 62 to adjust the work surface 102.

As the screw 26 rotates, the alignment sprocket 66 mounted at the top end 26C of the screw 26 also rotates. Since the alignment sprockets 66 of each adjustment mechanism 10 for a workstation 100 are connected together, when one (1) screw 26 of one (1) adjustment mechanism 10 is rotated, the screws 26 of the other adjustment mechanisms 10 are also rotated. Use of the alignment system allows for use of a single handle 62 and single operating mechanism to operate all the adjustment mechanisms 10 of a workstation 100 simultaneously. The alignment system also ensures that all of the adjustment mechanisms 10 are operating identically at the same speed and in the same direction.

It is intended that the foregoing description be only illustrative of the present invention and that the present invention be limited only by the hereinafter appended claims.

I claim:

1. An adjustment mechanism for vertically adjusting a work surface of a workstation, which comprises:

(a) a stationary first member defining a longitudinal axis of the mechanism;

(b) a movable second member connected to the work surface of the workstation and being movable relative to the stationary first member in a substantially vertical direction along the longitudinal axis of the mechanism;

(c) a support having a first end and a second end and fixably mounted at the second end to the stationary first member and having a threaded opening at the first end and a bore extending from the threaded opening toward the second end of the support substantially along the longitudinal axis of the mechanism;

(d) a threaded member rotatably connected to the movable second member and extending through the threaded opening of the support into the bore wherein threads of the threaded member engage threads of the threaded opening;

(e) a spring extending between the stationary first member and the movable second member substantially along the longitudinal axis of the mechanism and tending to bias the members apart; and (f) an operating mechanism for rotating the threaded member in the threaded opening of the support wherein as the threaded member rotates, the second member moves relative to the first member and the spring compressed or extends based on a direction of rotation of the threaded member.

2. The adjustment mechanism of claim 1 wherein the spring extends between an end of the first member opposite the second member and an end of the second member opposite the first member.

3. The adjustment mechanism of claim 1 wherein the spring is a linear spring such that a torque required to rotate the threaded shaft is reduced throughout the movement of the operating mechanism.

4. The adjustment mechanism of claim 1 wherein the spring is chosen such that at a point in movement of the second member relative to the first member, a force of the spring tending to bias the members apart acts to counterbalance a force of the work surface, operating mechanism, second member and load tending to move the members together.

5. The adjustment mechanism of claim 1 wherein a spring support is connected to the movable second member and positioned adjacent an inside surface of the spring and acts to support the spring.

6. The adjustment mechanism of claim 5 wherein the spring support extends a length of the second member.

7. The adjustment mechanism of claim 1 wherein the operating mechanism includes a rotation increasing means and a handle and wherein the rotation increasing means is adapted such that when the handle is rotated one complete rotation, the threaded member rotates greater than one complete rotation.

8. The apparatus of claim 1 wherein the force exerted by the spring is such that the threaded member can be in tension or compression depending on a load on the work surface.

9. The method of claim 1 wherein the threaded member contains five threads per inch such that when the handle is rotated one complete rotation, the work surface is adjusted approximately one inch (2.54 cm).

10. An adjustment mechanism for vertically adjusting a work surface of a workstation, which comprises:

(a) a first member having a first end and a second end with a bore extending therebetween;

(b) a second member telescopingly mounted in the bore of the first member and having a first end and a second end with a bore extending therebetween with the first end mounted adjacent the work surface of the workstation;

(c) a support-having a first end and a second end with a bore extending therebetween having a threaded opening at the first end and mounted in the bore of the first member such that the second end of the support is adjacent the second end of the first member and the first end of the support is adjacent the first end of the first member;

(d) a threaded member rotatably mounted in the bore of the second member having a first end and a second end defining a longitudinal axis of the adjustment mechanism with the first end rotatably mounted adjacent the first end of the second member wherein the second end of the threaded member extends through the threaded opening in the first end of the support and into the bore of the support;

(e) a first gear mounted on the first end of the threaded member;

(f) a second gear in contact with the first gear having a diameter greater than a diameter of the first gear and mounted on a first shaft having a longitudinal axis parallel to the longitudinal axis of the adjustment mechanism;

(g) a first sprocket connected to the second gear;

(h) a second sprocket spaced apart from and connected to the first sprocket and mounted on a second shaft having a longitudinal axis parallel to the longitudinal axis of the adjustment mechanism; and (i) a handle connected to the second shaft for rotating the second sprocket wherein rotating the handle rotates the second sprocket which rotates the first sprocket which rotates the second gear which rotates the first gear and the threaded member and wherein as the threaded member rotates in the threaded opening in the support, the second member is moved within the first member to vertically adjust the work surface of the workstation.

11. The adjustment mechanism of claim 10 wherein the diameter of the second gear is about 2.57 times the diameter of the first gear.

12. The adjustment mechanism of claim 10 wherein a diameter of the second sprocket is 2.07 times greater than a diameter of the first sprocket.

13. The adjustment mechanism of claim 10 wherein diameters of the first sprocket and second sprocket and first gear and second gear are such that when the handle is rotated one complete rotation, the threaded member rotates greater than one complete rotations.

14. The adjustment mechanism of claim 10 wherein a mounting cover is mounted adjacent an underneath surface of the work surface and wherein the first and second gears, first and second shafts, first and second sprockets and the threaded member are supported adjacent the underneath surface of the workstation by the mounting cover.

15. The adjustment mechanism of claim 14 wherein a bracket is mounted on the underneath surface of the work surface and secures the mounting cover to the work surface.

16. The adjustment mechanism of claim 10 wherein the first and second sprockets, the connection means and the first and second gears are mounted adjacent an underneath surface of the work surface and wherein a mounting cover is mounted on the underneath surface of the work surface over the first and second sprockets, the connection means and the first and second gear.

17. The apparatus of claim 10 mounted on a work surface wherein mounted adjacent the first gear on the threaded member is a first alignment sprocket with a chain connected to a second alignment sprocket on a second threaded member in a second adjustment mechanism so that the height of the adjustment mechanisms are the same, throughout a movement of the second member.

18. An adjustment mechanism for vertically adjusting a work surface of a workstation, which comprises:

(a) a stationary first member defining a longitudinal axis of the mechanism;

(b) a movable second member connected to the work surface of the workstation and being movable relative to the stationary first member in a substantially vertical direction along the longitudinal axis of the mechanism;

(c) a support having a first end and a second end and fixably mounted at the second end to the stationary first member and having a threaded opening at the first end and a bore extending from the threaded opening toward the second end of the support substantially along the longitudinal axis of the mechanism;

(d) a threaded member rotatably connected to the movable second member and extending through the threaded opening of the support into the bore wherein threads of the threaded member engage threads of the threaded opening;

(e) a spring extending between the stationary first member and the movable second member substantially along the longitudinal axis of the mechanism;

(f) a first gear mounted on the threaded member spaced apart from the stationary first member;

(g) a second gear rotatably mounted on a first shaft and positioned to engage the first gear;

(h) a first sprocket connected to the second gear;

(i) a second sprocket mounted on a rotatable second shaft spaced apart from the first shaft wherein the second sprocket is connected by a connection means to the first sprocket and wherein a diameter of the second sprocket is greater than a diameter of the first sprocket; and (j) rotation means for rotating the second rotatable shaft wherein when the second rotatable shaft is rotated, the second sprocket is rotated which rotates the first sprocket and the second gear which rotates the first gear and the threaded member and wherein as the threaded member rotates in the threaded opening of the support, the movable second member moves relative to the stationary first member to adjust the work surface of the workstation.

19. The adjustment mechanism of claim 18 wherein a diameter of the second gear is about 2.57 times a diameter of the first gear.

20. The adjustment mechanism of claim 18 wherein the diameter of the second sprocket is about 2.07 times greater than the diameter of the first sprocket.

21. The adjustment mechanism of claim 18 wherein diameters of the first sprocket and second sprocket and first gear and second gear are such that when the handle is rotated one complete rotation, the threaded member rotates approximately five complete rotations.

22. The adjustment mechanism of claim 18 wherein a mounting cover is mounted adjacent an underneath surface of the work surface and wherein the first and second gears, first and second shafts, first and second sprockets and the threaded member are supported adjacent the underneath surface of the workstation by the mounting cover.

23. The adjustment mechanism of claim 22 wherein a bracket is mounted on the underneath surface of the work surface and secures the mounting cover to the work surface.

24. The adjustment mechanism of claim 18 wherein the rotation means is a handle connected to the second shaft.

25. The adjustment mechanism of claim 18 wherein the first and second sprockets, the connection means, and the first and second gears are mounted adjacent an underneath surface of the work surface and wherein a cover is mounted on the underneath surface of the work surface over the first and second sprockets, connection means and the first and second gear.

26. The adjustment mechanism of claim 18 wherein the spring has a length such as to extend a length of the first and second members when the adjustment mechanism is in a fully extended position.

27. The adjustment mechanism of claim 18 wherein a spring support is connected to the moveable second member and positioned adjacent an inside surface of the spring and acts to support the spring.

28. The adjustment mechanism of claim 27 wherein the spring support extends substantially a length of the second member.

29. The adjustment mechanism of claim 18 wherein a cantilever bracket is mounted on an end of the second member adjacent the first member and wherein the cantilever bracket has rollers which contact the first member when the second member moves relative to the first member in a direction substantially along the longitudinal axis of the adjustment mechanism.

30. The adjustment mechanism of claim 29 wherein the cantilever bracket includes a pair of rollers and wherein the rollers are spaced apart approximately 180° on of the cantilever bracket perpendicular to a front edge of the work surface.

31. The adjustment mechanism of claim 18 wherein a cantilever bracket having rollers is mounted in the first member adjacent the second member and assists the second member in moving relative to the first member.

32. The adjustment mechanism of claim 31 wherein the cantilever rollers are spaced apart approximately 45° around a center opening on a side of the cantilever bracket adjacent a front edge of the work surface.

33. The adjustment mechanism of claim 18 wherein the adjustment mechanism has an alignment sprocket mounted on the threaded member, wherein the alignment sprocket of the adjustment mechanism is connected by at least one chain to at least one alignment sprocket of at least one secondary adjustment mechanism wherein the secondary adjustment mechanisms are similar to the adjustment mechanism except that the secondary adjustment mechanisms do not have the first and second gears, the first and second sprockets, the first and second shafts and the handle, wherein the connection of the adjustment mechanism to the secondary adjustment mechanisms allows the adjustment mechanisms to adjust the work surface of the workstation at a similar rate and wherein at least one cover is mounted to an underneath surface of the work surface and extends between the alignment sprockets to cover the chains.

34. An adjustment mechanism for vertically adjusting a work surface of a workstation, which comprises:

(a) a first member having a first end and a second end with a bore extending therebetween;

(b) a second member telescopingly mounted in the bore of the first member and having a first end and a second end with a bore extending therebetween with the first end mounted adjacent the work surface of the workstation;

(c) a support having a first end and a second end with a bore extending therebetween having a threaded opening at the first end and mounted in the bore of the first member such that the second end of the support is adjacent the second end of the first member and the first end of the support is adjacent the first end of the first member;

(d) a threaded member rotatably mounted in the bore of the second member having a first end and a second end defining a longitudinal axis of the adjustment mechanism with the first end rotatably mounted adjacent the first end of the second member wherein the second end of the threaded member extends through the threaded opening in the first end of the support and into the bore of the support;

(e) a spring mounted in the bore of the second member and around the threaded member having a first and a second end with the first end adjacent the first end of the second member and the second end adjacent the second end of the first member;

(f) a first gear mounted on the first end of the threaded member;

(g) a second gear in contact with the first gear and mounted on a first shaft having a longitudinal axis parallel to the longitudinal axis of the adjustment mechanism and having a diameter greater than a diameter of the first gear;

(h) a first sprocket connected to the second gear;

(i) a second sprocket spaced apart from and connected to the first sprocket and mounted on a second shaft having a longitudinal axis parallel to the longitudinal axis of the adjustment mechanism: and (j) a handle connected to the second shaft for rotating the second sprocket wherein rotating the handle rotates the second sprocket which rotates the first sprocket and the second gear which rotates the first gear and the threaded member and wherein as the threaded member rotates in the threaded opening in the support, the second member is moved within the first member to vertically adjust the work surface of the workstation.

35. The adjustment mechanism of claim 34 wherein the diameter of the second gear is about 2.57 times the diameter of the first gear.

36. The adjustment mechanism of claim 34 wherein a diameter of the second sprocket is 2.07 times greater than a diameter of the first sprocket.

37. The adjustment mechanism of claim 34 wherein diameters of the first sprocket and second sprocket and first gear and second gear are such that when the handle is rotated one complete rotation, the threaded member rotates approximately five complete rotations.

38. The adjustment mechanism of claim 34 wherein a mounting cover is mounted adjacent an underneath surface of the work surface and wherein the first and second gears, first and second shafts, first and second sprockets and the threaded member are supported adjacent the underneath surface of the workstation by the mounting cover.

39. The adjustment mechanism of claim 38 wherein a bracket is mounted on the underneath surface of the work surface and secures the mounting cover to the work surface.

40. The adjustment mechanism of claim 34 wherein the first and second sprockets, the connection means and the first and second gears are mounted adjacent an underneath surface of the work surface and wherein a mounting cover is mounted adjacent the underneath surface of the work surface over the first and second sprockets, the connection means and the first and second gears.

41. The adjustment mechanism of claim 34 wherein the second member has an inner plate mounted in the bore of the second member adjacent the first end wherein the inner plate has an opening through which the threaded member extends.

42. The adjustment mechanism of claim 41 wherein a thrust assembly is mounted on the threaded member on either side of the inner plate such that the threaded member easily rotates in the opening of the inner plate.

43. The adjustment mechanism of claim 41 wherein the opening of the inner plate is located in an indention in the plate and wherein a flange bearing is mounted in the indention and wherein the threaded member extends through an opening in the flange bearing.

44. The adjustment mechanism of claim 34 wherein a spring support is connected to the second member and positioned adjacent an inside surface of the second member and acts to support the spring.

45. The adjustment mechanism of claim 34 wherein a cantilever bracket is mounted on the second end of the second member and wherein the cantilever bracket has rollers which contact an inner surface of the first member when the second member moves relative to the first member.

46. The adjustment mechanism of claim 45 wherein the cantilever bracket includes a pair of rollers and wherein the rollers are spaced apart approximately 180° on the cantilever bracket perpendicular to a front edge of the work surface.

47. The adjustment mechanism of claim 46 wherein the cantilever rollers are spaced apart approximately 45° around a center opening of the cantilever bracket on a side of the cantilever bracket adjacent a front edge of the work surface.

48. The adjustment mechanism of claim 34 wherein a cantilever bracket having cantilever rollers is mounted in the first end of the first member and assists the second member in moving relative to the first member.

49. The adjustment mechanism of claim 34 wherein the adjustment mechanism has an alignment sprocket mounted on the threaded member, wherein the alignment sprocket of the adjustment mechanism is connected by at least one chain to at least one alignment sprocket of at least one secondary adjustment mechanism wherein the secondary adjustment mechanisms are similar to the adjustment mechanism except that the secondary adjustment mechanisms do not have the first and second gears, the first and second sprockets, the first and second shafts and the handle, wherein the connection of the adjustment mechanism to the secondary adjustment mechanisms allows the adjustment mechanisms to adjust the work surface of the workstation at a similar rate and wherein at least one cover is mounted to an underneath surface of the work surface and extends between the alignment sprockets to cover the chains.

50. A method for adjusting a height of a work surface of a workstation which comprises the steps of:

(a) providing an adjustment mechanism for the work surface of the workstation, the adjustment mechanism including a stationary first member defining a longitudinal axis of the mechanism; a movable second member connected to the work surface of the workstation and being movable relative to the stationary first member in a substantially vertical direction along the longitudinal axis of the adjustment mechanism; a support having a first end and a second end and fixably mounted at the second end to the stationary first member and having a threaded opening at the first end and a bore extending from the threaded opening toward the second end of the support substantially along the longitudinal axis of the adjustment mechanism; a threaded member rotatably connected to the movable second member and extending through the threaded opening of the support into the bore wherein threads of the threaded member engage threads of the threaded opening; a spring extending between the stationary first member and the movable second member substantially along the longitudinal axis of the adjustment mechanism; a first gear mounted on the threaded member spaced apart from the stationary first member; a second gear rotatably mounted on a first shaft and positioned to engage the first gear wherein a diameter of the second gear is greater than a diameter of the first gear; a first sprocket connected to the second gear; a second sprocket mounted on a rotatable second shaft spaced apart from the first shaft wherein the second sprocket is connected by a connection means to the first sprocket; and rotation means for rotating the second rotatable shaft wherein when the second rotatable shaft is rotated, the second sprocket is rotated which rotates the first sprocket and the second gear which rotates the first gear and the threaded member and wherein as the threaded member rotates in the threaded opening of the support, the movable second member moves relative to the stationary first member to adjust the work surface of the workstation; and (b) activating the rotation means such that the second shaft and second sprocket rotate which rotates the first sprocket and second gear which rotates the first gear and the threaded member which moves the second member relative to the first member which adjusts the height of the work surface.

51. The method of claim 50 wherein the rotation means is a handle connected to the second shaft and wherein when the handle is rotated one complete rotation, the threaded member rotates approximately five complete rotations.

52. The methods of claim 51 wherein the threaded member contains five threads per inch such that when the handle is rotated one complete rotation, the work surface is adjusted approximately one (1) inch (2.54 cm).

53. The method of claim 50 wherein the adjustment mechanism is mounted on a work surface, wherein mounted adjacent to the first gear on the threaded member is a first alignment sprocket with a chain connected to a second alignment sprocket on a second threaded member in a second adjustment mechanism so that the height of the adjustment mechanisms is the same.

* * * * *